United States Patent [19]

Mitsui et al.

[11] 4,087,282

[45] May 2, 1978

[54] FLOCCULATING AGENT FOR PHOTOGRAPHIC EMULSIONS

[75] Inventors: Akio Mitsui; Takushi Miyazako; Takashi Ogawa, all of Minami-ashigara, Japan

[73] Assignee: Fuji Photo Film Co., Ltd., Minami-ashigara, Japan

[21] Appl. No.: 723,858

[22] Filed: Sep. 16, 1976

[30] Foreign Application Priority Data

Sep. 16, 1975 Japan ..... 50-111913

[51] Int. Cl.[2] ..... G03C 1/02; G03C 1/72; C02B 1/20

[52] U.S. Cl. ..... 96/94 R; 96/114; 210/54

[58] Field of Search ..... 96/94 R, 114; 210/54 R

[56] References Cited

U.S. PATENT DOCUMENTS 2,772,165 11/1956 Moede ..... 96/114

FOREIGN PATENT DOCUMENTS 1,145,485 3/1963 Germany ..... 96/114
648,472 1/1951 United Kingdom ..... 96/114

*Primary Examiner*—J. Travis Brown
*Assistant Examiner*—L. Falasco
*Attorney, Agent, or Firm*—Sughrue, Rothwell, Mion, Zinn and Macpeak

[57] ABSTRACT

A method of flocculating a gelatin-silver halide photographic emulsion, which comprises flocculating the silver halide with gelatin at a pH of 6 or less in the presence of a polymer consisting essentially of recurring units represented by General Formula (Ia) or (Ib):

General Formula (Ia)

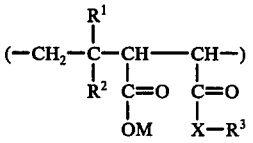

General Formula (Ib)

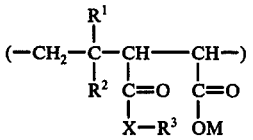

in which $R^1$ and $R^2$, which can be the same or different, represent aliphatic groups, $R^3$ represents a hydrogen atom, an aliphatic group, an aryl group or an aralkyl group, X represents —O— or —NH—, M represents a cation and X and $R^3$ may linked to each other to form a cyclic amino group.

18 Claims, No Drawings

FLOCCULATING AGENT FOR PHOTOGRAPHIC EMULSIONS

BACKGROUND OF THE INVENTION

1. Filed of the Invention

This invention relates to a process for the production of a gelatin-silver halide photographic emulsion, particualrly, it is also concerned with a novel flocculating agent used during the production thereof and a method of flocculating gelatin and a silver halide.

2. Description of the Prior Art

A gelatin-silver halide photographic emulsion is ordinarily prepared by (1) forming and growing fine silver halide crystals by the double decomposition of a silver salt and halide salt in the presence of gelatin, (2) controlling the silver ion concentration, hydrogen ion concentration, etc., in the system by removing excess halide salt and a salt formed by the decomposition, and, if necessary, (3) adding a suitable sensitizer, followed by ageing.

In processes for the production of emulsions, as have been long practiced, the step (2) of removing salts is carried out by cooling and gelling the emulsion, finely dividing the resulting gel and washing with water after the step (1) of forming the fine crystals. This process, however, has the disadvantage that not only is a large amount of water and a long time required for water washing, also a gelatin concentration of some extent is required for gelling, and it is thus necessary to thicken the reaction solution in the case of preparing an emulsion containing a small amount of gelatin for a certain amount of a silver halide, and it is often impossible to obtain desirable photographic properties.

In order to overcome the above described disadvantages, it has been proposed to prepare emulsions by flocculating silver halide fine crystals formed in the presence of a relatively small amount of gelatin together with gelatin, followed by washing and redispersing. For example, there are, as methods of effecting this flocculation, a method comprising using a large amount of an inorganic salt, a method comprising using an organic solvent and a method comprising using a gelatin derivative or synthetic high molecular substance. The method comprising using an inorganic salt requires a large amount of the inorganic salt, while the method comprising using an organic solvent has the disadvantage that it is difficult to recover the expensive organic solvent. The method comprising using a gelatin derivative or high molecular substance can be carried out effectively at relatively low cost, and, in the case of using a synthetic high molecular substance, it is added to a silver halide emulsion containing gelatin and then a complex of a gelatin-synthetic high molecular substance containing the silver halide fine crystals is flocculated by lowering the pH of the system or adding a polyvalent metal salt thereto. The thus flocculated substance is washed with water, redispersed by raising the pH and then applied to the intended use, optionally with the addition of gelatin or sensitizers, ageing, etc.

It has hitherto been proposed to use a copolymer of maleic acid as a flocculating agent for a photographic emulsion as a high molecular substance (see British patent specification No. 648,472, U.S. Pat. No. 2,772,165 and West German Pat. No. 1,145,485).

As a flocculating agent for photographic emulsions, compounds capable of achieving this purpose at smaller amounts thereof are advantageous. That is to say, the smaller the amount of it such an agent, the more excellent is the redispersibility and the less troubles are encountered in succesively effecting chemical ageing, spectral sensitization, development and color development.

Generally, flocculating is carried out while lowering the pH, but the pH of a suitable flocculation depends upon the kind of flocculating agent used. A flocculating agent that is not effective unless the pH is lowered at the time of flocculating often has a harmful influence on the photographic properties of silver halide particles in an emulsion, depending upon the pH. Therefore, it is desirable that the pH not be so lowered at the time of flocculating, if possible. In the foregoing patent, it is disclosed that the pH ranges from 4 to 5.5, but insufficient flocculating occurs unless the pH is lowered to 3 to 4 in the case of a relatively low concentration gelatin emulsion.

From an economical point of view, it is desirable to obtain a flocculating agent as cheaply as possible. In this aspect also, the prior art flocculating agents are insufficient.

SUMMARY OF THE INVENTION

It is one object of the present invention to provide a synthetic high molecular flocculating agent which is inexpensive and capable of exhibiting excellent flocculating effects in small amounts and makes it possible to easily disperse after flocculation without deteriorating the photographic property of the silver halide emulsion.

It is another object of the present invention to provide a method comprising flocculating a silver halide with gelatin using such a flocculating agent.

It is yet a further object of the present invention to provide a method for making a silver halide photographic emulsion by the use of such a flocculating agent which permits one to wash or effectively remove useless or harmful salts.

These objects can be attained by flocculating gelatin and silver halide using a polymer having a recurring unit represented by the following general formula (I*a*) or (I*b*), General Formula (Ia)

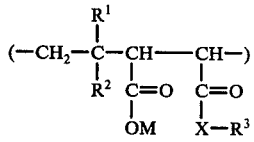

General Formula (Ib)

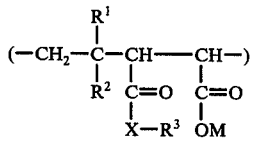

in which $R^1$ and $R^2$ may be same or different and represent aliphatic groups, for example, alkyl groups having 1 to 16 carbon atoms such as methyl and isoamyl groups, $R^3$ represents a hydrogen atom, an aliphatic group, for example, an alkyl group having 1 to 18 carbon atoms or an allyl group, an aryl group, preferably an aryl group having 6 to 16 carbon atoms, or an aralkyl group, preferably an aralkyl group having 6 to 16 carbon atoms, such as a phenethyl group, X represents —O— or —NH, M represents a cation, for example, hydrogen, an alkali metal such as Na or K, an ammonium group or an amine such as an aliphatic amine or an aromatic amine, for example, dimethylamine or aniline, and X and $R^3$ may be linked each other to form a cyclic (5- or 6-membered) amino group.

Preferably, the molecular weight of this polymer is in the range of about $2 \times 10^3$ to about $5 \times 10^5$, in particular, $3 \times 10^3$ to $2 \times 10^5$. In the polymers of the above general formulae, since the molecular weight is relatively high and the polymers consist essentially of the recurring units, the terminal groups thereof can essentially be ignored, and have no substantial impact upon the present invention.

The polymer used in the invention can be obtained from a polymer of an olefin and maleic anhydride (polymer containing a recurring unit represented by the following general formula (II), where the olefin is an $\alpha$, $\beta$-unsaturated olefin represented by the formula

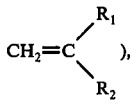

as disclosed in, for example, U.S. Pat. No. 2,957,767, which is incorporated by reference, and Japanese Pat. Publication No. 23827/1974. The copolymer is commercially available as, e.g., ISOBAM (tradename, made by Kuraray Co., Ltd.). Examples of the olefin are isobutylene, 4-pentene, 1-hexene, 1-heptene, diisobutylene, 1-octene, 1-nonene, 1-decene, 1-undecene, 1-dodecene and 1-octadecene.

General Formula (II)

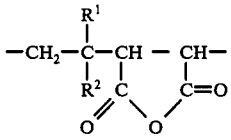

wherein $R^1$ and $R^2$ have the same meaning as in General Formula (I*a*) or (I*b*).

The polymer used in the present invention can be synthesized by subjecting a polymer containing a recurring unit represented by the above General Formula (II) to hydrolysis with an alkali, to esterification with an alcohol or to conversion into a half amide with an amine, as disclosed in, for example, U.S. Pat. No. 2,957,767, column 2 line 72 to column 3 line 28.

Examples of the recurring unit of General Formula (Ia) or (Ib) are as follows:

1

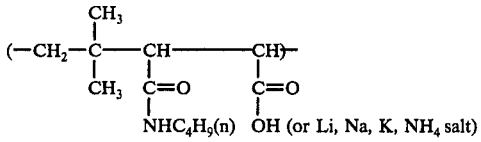

2

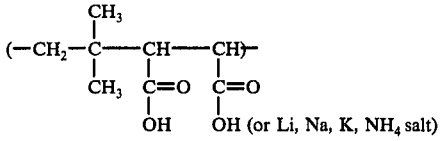

-continued

3

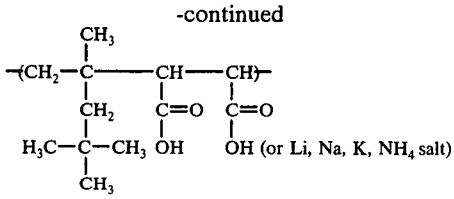

4

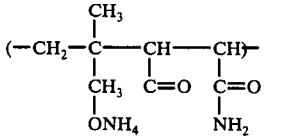

5

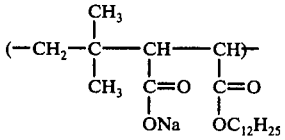

6

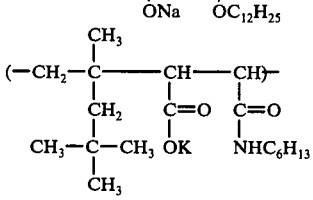

7

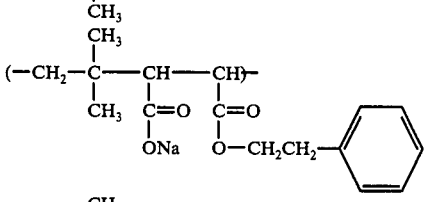

8

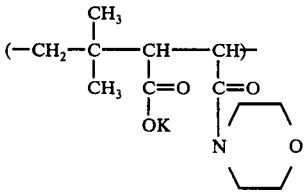

9

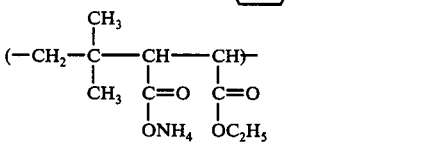

10

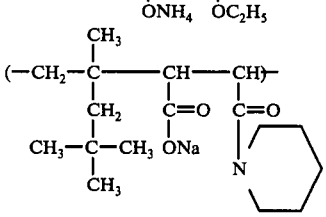

The polymer of the present invention has particularly excellent properties as a flocculating agent for photographic emulsions. The prior art flocculating agents consisting of a maleic acid type copolymer had a hydrophilic segment (maleic acid) and a relatively hydrophobic segment (another vinyl compound), and tests of the emulsion flocculationg property and redispersibility have shown that a suitable selection of a hydrophobic segment has a great influence upon the flocculating and redispersion properties thereof. In particular, it has now been found that the polymer of the present invention is excellent in flocculating and redispersion properties (that is to say, a particularly small amount of the flocculating agent added is sufficient, and sufficient flocculating can be obtained even though the pH at the time of flocculating is not so lowered as in the case of using the prior art maleic acid type copolymer, and, thus, redispersibility is excellent) and a silver halide photographic emulsion prepared by flocculating with this polymer, followed by washing, has excellent photographic properties.

In greater detail, in the case of using the polymer of the invention, flocculating is possible using a particularly small amount thereof, and, for example, a sufficient and rapid flocculating can be effected using an amount of 0.1 to 0.9 times the amount of the prior art maleic acid type copolymers. Furthermore, where an emulsion contains a relatively low concentration of gelatin, it is necessary to lower the pH at flocculating to 3.0 to 4.0 in the case of the prior art maleic acid copolymer, while in the case of the polymer of the invention, a good flocculating property can be obtained within a relatively high pH range such as at a pH of equal to or less than 6. If this selected pH range is utilized, the polymer of the present invention selectively functions as a flocculating agent. Since the size of the flocculated aggregate according to the present invention is large, a high flocculating speed and excellent redispersibility can be obtained. A photographic silver halide emulsion prepared using the flocculating agent of this invention has good photographic properties without any problems during chemical ageing, spectral sensitization and development or color development.

When using the polymer of the present invention for flocculating, it can be added to an emulsion or gelatin solution in any stage before flocculating, but it is most preferred to add the polymer of the invention after the fine silver halide crystals are formed and grown in a gelatin solution.

When carrying out flocculating, an acid is preferably added to lower the pH, and as the acid there can be used organic acids such as acetic acid, citric acid and salicyclic acid and inorganic acids such as phosphoric acid, hydrochloric acid and sulfuric acid. A pH of about 6 or less, in particular, 4.5 to 3.5 is most suitable for flocculating. Such an acid is preferably added after the polymer of the invention is added. The addition of a heavy metal ion capable of being combined with a carboxylic group in the polymer, such as a zirconium, cadmium, lead or zinc ion, to an emulsion is effective to reduce the amount of a flocculating agent used and for effecting flocculating at a relatively high pH.

The polymer can be added and dissolved in an emulsion as a solid, but it is preferable to add it in the form of about a 10% aqueous solution. The amount of the polymer added is about 1/50 to about 1/4 times by weight, in particular, 1/40 to 1/10 times by weight, that of the gelatin contained in the emulsion at the time of flocculating.

The gelatin concentration of the system before settling is about 0.5 to about 10% by weight, more preferably 0.5 to 2% by weight, or less.

It is preferred that the temperature of flocculating be about 30° to about 50° C, more preferably 35° to 45° C. Flocculation may be conducted by allowing the system to stand at normal temperature or by centrifugally separating the floc.

A method comprising subjecting a water-soluble halide and a silver salt to double decomposition reaction in the presence of some polymers within the class of polymers of this invention to thereby forming a fine particle silver halide photographic emulsion is known and described in U.S. Pat. No. 2,957,767, but the object or effect of using a polymer of this kind is to prepare a fine particle silver halide and to improve photographic sensitivity, which is intrinsically different from the object or effect of using the polymer of the present invention, that is, from a "flocculating agent for photographic emulsions". In the method of using a polymer according to the above Patent, the presence of the polymer in the double decomposition reaction system until silver halide particles are formed is important, and it matters little how the polymer is processed thereafter. According to ordinary processing, this polymer will be washed out of the emulsion by water. On the other hand, in the present invention, the presence of the polymer when a silver halide is formed is not particularly prohibited, but it is important that the polymer be present at the time silver halide is completely flocculated with gelatin by lowering the pH after the silver halide is formed, i.e., in the present invention, if the earlier resulted limitations are met, the polymer selectively functions as a flocculating agent, irrespective of the timing of the addition of the polymer.

The present invention can be applied to any silver halide emulsions such as silver chloride, silver bromide, silver chlorobromide, silver iodobromide and silver chloroiodobromide.

An emulsion used in the invention can be chemically sensitized in known manner using compounds containing unstable sulfur, for example, ammonium thiosulfate and allylthourea (cf. P. Glafkides, Chimie Photographique, 2'eme Edition, Photocinema, Paul Montel, Paris (1957), page 297–299), gold compounds, for example, a complex salt of monovalent gold and thiocyanic acid (cf. ibid page 301) or mixtures of these compounds.

Moreover, an emulsion can be optically sensitized by adding color sensitizers, for example, cyanine dyes, merocyanine dyes, etc. (cf. S. Kikuchi, "Kagaku Shashin Binran" published by Maruzen Co., 1959, page 15–24). In particular, merocyanine dyes (see U.S. Pat. No. 2,493,748) and cyanine dyes having acid groups (see U.S. Pat. No. 2,503,776) can favorably be used because of having a low dyeing property for these high molecular weight materials.

An emulsion can be stabilized by stabilizers well known in the art, for example, heterocyclic compounds such as benzotriazole, 1-phenyl-5-mercaptotetrazole, 4-hydroxy-6-methyl-1,3,3*a*,7-tetrazaindene and 6-thioctic acid, mercury compounds such as mercumallylic acid (see Japanese Patent Publication No. 22063/1964), and benzenesulfonic acid. An emulsion can further be subjected to a hardening treatment using hardeners such as formaldehyde, mucochloric acid, chrome alum and triazine derivatives (see Belgian Pat. No. 641,044), optionally with hardening aids such as resorcinol and resorcylaldehyde. For ease of coating, surfactants such as saponin, sodium alkylbenzenesulfonates and addition polymers of alkylphenols and sultones (see Japanese Patent Application No. 34645/1963) can be added to an emulsion. An emulsion can be sensitized using polyalkylene oxide derivatives such as condensation products of alkylphenols and polyethylene oxide, if desired. An emulsion prepared according to the present invention can also be used for the production of films or printing papers for color photography by the addition of color couplers in a conventional manner.

The following examples are given in order to illustrate the present invention in greater detail without limiting the same. In the following Examples, all percentages are weight percentages, unless otherwise indicated.

EXAMPLE 1

A silver halide emulsion was prepared using the following polymers (i) to (ix) as a flocculating agent for the emulsion:

| | |
|---|---|
| First Solution | |
| Gelatin | 20.0 g |
| Water | 1000 ml |
| Temperature | 50° C |
| Second Solution | |
| Silver nitrate | 100 g |
| Water | to 500 ml |
| Temperature | 45° C |
| Third Solution | |
| Potassium bromide | 35 g |
| Sodium chloride | 18 g |
| Water | to 500 ml |
| Temperature | 45° C |

A flocculating test of a complex of gelatin and the polymer was carried out by adding the Second Solution and the Third Solution in equal amounts (500 ml each) to the First Solution at 50° C over a 20 minute period, lowering the temperature to 40° C over a 10 minute period, adding thereto a 10% solution of the polymer, mixing the system, adding a 5% aqueous solution of phosphoric acid to lower the pH and then stopping the stirring. As to each of polymers (i) to (ix), the amount thereof and the pH required for flocculating are shown in the right column of Table 1. As can been seen from this table, polymers (i) to (iv) give a higher pH for optimum flocculating, a smaller amount of these flocculating agents can be used and better redispersibility was obtained than with polymers (v) to (ix).

Table 1

| Polymer | Recurring Unit represented by General Formula (Ia) or (Ib) X | M | $R^3$ | $R^1$ | $R^2$ | Polymerization Degree | Amount ml* | pH |
|---|---|---|---|---|---|---|---|---|
| i) | 0 | Na | H | $CH_3$ | $CH_3$ | about 200 | 6 | 3.8 |
| ii) | " | " | " | " | " | about 300 | 5 | " |
| iii) | " | " | " | " | " | about 500 | 3 | " |
| iv) | " | " | " | " | $C_4H_9$ | about 200 | 10 | 4.0 |
| v) | | | a | | | about 200 | 11 | 3.4 |
| vi) | | | b | | | " | 10 | 3.6 |
| vii) | | | c | | | " | 11 | 3.4 |
| viii) | | | d | | | " | 10 | 3.6 |
| ix) | | | e | | | " | 15 | 3.4 |

*10% solution

From each of the emulsions obtained by the use of polymers (i) to (ix) as flocculating agents, 1400 ml of the supernatant was removed by decantation. 2000 ml of water containing 4 ml of a 5% solution of phosphoric acid was then added thereto, the system stirred and stirring stopped to cause a rapid flocculating. After 2000 ml of the supernatant was removed by decantation, the emulsion was mixed with 600 ml of water and 100 g of gelatin, and then the pH was raised to 6.0 by adding an aqueous solution of sodium carbonate (all at 40° C), whereafter the liquid temperature was raised to 60° C for 10 minutes and the system subjected to chemical ageing (gold and sulfur sensitization) in a conventional manner. The resulting emulsion had good photographic properties similar to those of the emulsion prepared in a known manner.

The polymers (v) to (ix) had, respectively, the following recurring units:

a
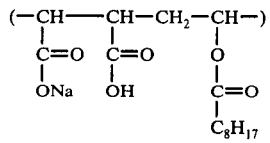

b
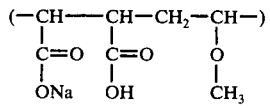

c
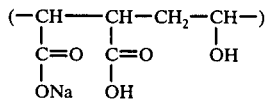

d
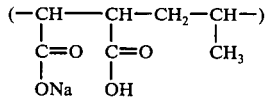

e
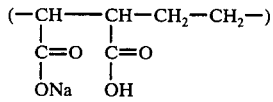

EXAMPLE 2

A silver chlorobromide was prepared using polymer (i) as a flocculating agent as in Example 1.

| | |
|---|---|
| First Solution | |
| Potassium bromide | 70.0 g |
| Sodium Chloride | 10.3 g |
| Gelatin | 20 g |
| Water | 1000 ml |
| Temperature | 60° C |
| Second Solution | |
| Silver nitrate | 100 g |
| Water | to 1000 ml |
| Temperature | 50° C |

The First Solution was added to the Second Solution over a 20 minute period at 60° C, and then the temperature was lowered to 40° C. 18 ml of a 5% solution of polymer (i) was added, the system mixed, a 10% solution of phosphoric acid was added to lower the pH to 4.0 and the stirring stopped. A rapid flocculating took place and the emulsion was completely flocculated in 10 minutes.

1600 ml of the supernatant was removed by decantation and 2600 ml of cold water containing 2.6 ml of a 10% solution of phosphoric acid was added followed by stirring for 3 minutes. After the stirring was stopped and the emulsion was completely flocculated, 2600 ml of the supernatant was removed and 1000 ml of water containing 6 ml of a 5% aqueous solution of sodium carbonate was added to raise the pH to 6.1, followed by redispersing the emulsion. Simultaneously, the temperature was raised to 60° C and then 100 g of gelatin was added. The emulsion was then subjected to chemical ageing (sulfur ageing) in a conventional manner. The photographic emulsion prepared in this way was spectrally sensitized well by dyes and gave a good coloring if a coupler was present to yield a sharp image. Thus, this photographic emulsion was suitable as a raw emulsion for a color print paper.

While the invention has been described in detail and with reference to specific embodiments thereof, it will be apparent to one skilled in the art that various changes and modifications can be made therein without departing from the spirit and scope thereof.

What is claimed is:

1. A method of flocculating a gelatin-silver halide photographic emulsion, which comprises flocculating the silver halide with gelatin at a pH of 6 or less in the presence of a polymer consisting essentially of recurring units represented by General Formula (*Ia*) or (*Ib*):

General Formula (Ia)

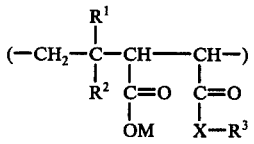

General Formula (Ib)

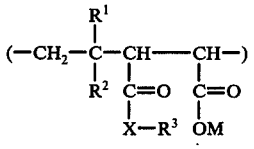

in which $R^1$ and $R^2$, which can be the same or different, represent aliphatic groups, $R^3$ represents a hydrogen atom, an aliphatic group, an aryl group or an aralkyl group, X represents —O— or —NH—, M represents a cation and X and $R^3$ may be linked to each other to form a cyclic amino group.

2. The method of flocculating as claimed in claim 1, wherein the molecular weight of the polymer is about 2,000 to about 500,000.

3. The method of flocculating as claimed in claim 1, wherein the gelatin concentration of the system before the settling is about 0.5 to about 10% by weight.

4. The method of flocculating as claimed in claim 1, wherein the amount of the polymer added is about 1/50 to about ¼ times by weight as much as the amount of the gelatin contained in the emulsion.

5. The method of flocculating as claimed in claim 1, wherein the polymer is added to the gelatin-silver halide system after the silver halide is formed.

6. The method of flocculating as claimed in claim 2, wherein said molecular weight is 3,000 to 200,000.

7. The method of flocculating as claimed in claim 1, wherein said aliphatic groups for $R^1$ and $R^2$ are alkyl groups having 1 to 16 carbon atoms.

8. The method of flocculating as claimed in claim 7, wherein said alkyl groups are methyl and isoamyl groups.

9. The method of flocculating as claimed in claim 1, wherein for $R^3$, said aliphatic group is an alkyl group having 1 to 18 carbon atoms or an allyl group, said aryl group has 6 to 16 carbon atoms and said aralkyl group has 6 to 16 carbon atoms.

10. The method of flocculating as claimed in claim 1, wherein for M, said cation is hydrogen, an alkali metal, an ammonium group or an amine.

11. The method of flocculating as claimed in claim 1, wherein said recurring units represented by General Formula (*Ia*) or (*Ib*) are selected from the following units:

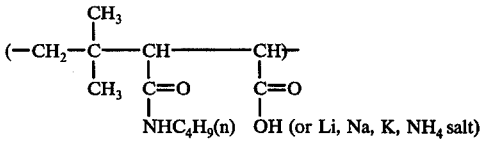

-continued

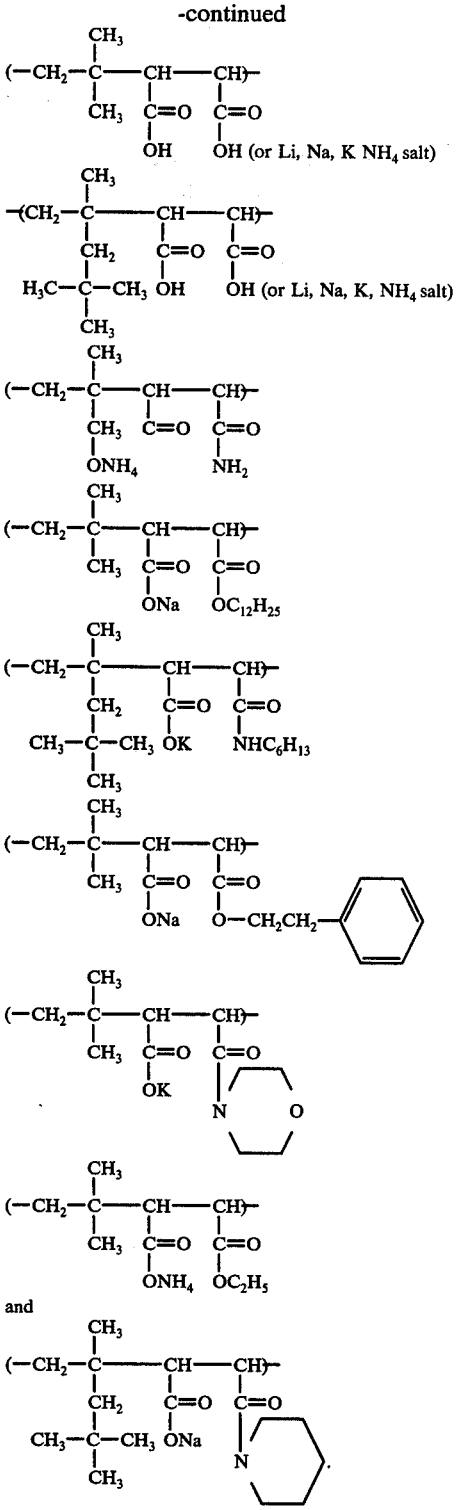

12. The method of flocculating as claimed in claim 3, wherein said gelatin concentration is 0.5 to 2% by weight.

13. The method of flocculating as claimed in claim 1, wherein said pH is 4.5 to 3.5.

14. The method of flocculating as claimed in claim 4, wherein said amount of polymer added is 1/40 to 1/10 times by weight as much as the amount of the gelatin contained in the emulsion.

15. The method of flocculating as claimed in claim 1, wherein said flocculating is at a temperature of about 30° to about 50° C.

16. The method of flocculating as claimed in claim 15, wherein said temperature is 35° to 45° C.

17. The method of flocculating as claimed in claim 1, wherein in the General Formula (I*a*) or (I*b*):

i. X is O, M is Na, $R^3$ is H, $R^1$ is $CH_3$, $R^2$ is $CH_3$ and the polymerization degree is about 200;

ii. X is O, M is Na, $R^3$ is H, $R^1$ is $CH_3$, $R^2$ is $CH_3$ and the polymerization degree is about 300;

iii. X is O, M is Na, $R^3$ is H, $R^1$ is $CH_3$, $R^2$ is $CH_3$ and the polymerization degree is about 500; or iv. X is O, M is Na, $R^3$ is H, $R^1$ is $CH_3$, $R^2$ is $C_4H_9$ and the polymerization degree is about 200.

18. The method of flocculating as claimed in claim 17, wherein in the General Formula (I*a*) or (I*b*) X is O, M is Na, $R^3$ is H, $R^1$ is $CH_3$, $R^2$ is $CH_3$ and the polymerization degree is about 200.

* * * * *